US010240238B2

(12) United States Patent
Croopnick

(10) Patent No.: US 10,240,238 B2
(45) Date of Patent: Mar. 26, 2019

(54) NICKEL BASED THERMAL SPRAY POWDER AND COATING, AND METHOD FOR MAKING THE SAME

(75) Inventor: Gerald A. Croopnick, Coto De Caza, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 0 days.

(21) Appl. No.: 13/576,563

(22) PCT Filed: Feb. 1, 2011

(86) PCT No.: PCT/US2011/023395
§ 371 (c)(1),
(2), (4) Date: Sep. 14, 2012

(87) PCT Pub. No.: WO2011/094755
PCT Pub. Date: Aug. 4, 2011

(65) Prior Publication Data

US 2013/0004786 A1 Jan. 3, 2013

Related U.S. Application Data

(60) Provisional application No. 61/300,381, filed on Feb. 1, 2010.

(51) Int. Cl.
*C23C 4/06* (2016.01)
*C23C 24/04* (2006.01)
(Continued)

(52) U.S. Cl.
CPC ..... *C23C 24/04* (2013.01); *C23C 4/067* (2016.01); *C23C 4/10* (2013.01); *Y10T 428/12* (2015.01);
(Continued)

(58) Field of Classification Search
CPC ..... C23C 4/04; C22C 45/04
See application file for complete search history.

(56) References Cited

U.S. PATENT DOCUMENTS 2,390,140 A * 12/1945 Weisberg et al. ..... 560/179
3,719,519 A 3/1973 Perugini
(Continued)

FOREIGN PATENT DOCUMENTS

CN 1031865 A 3/1989
CN 2865209 Y 1/2007
(Continued)

OTHER PUBLICATIONS

"Nickel Chrome Alloys", 2006, p. 1-3. http://web.archive.org/web/20060716040939/http://www.nickel-alloys.net/nickel_chrome_alloys.html.*

(Continued)

*Primary Examiner* — Mark Ruthkosky
*Assistant Examiner* — Julia L Rummel
(74) *Attorney, Agent, or Firm* — Brownstein Hyatt Farber Schreck, LLP

(57) ABSTRACT

Provided in one embodiment includes a multi-fully alloyed powder that provides a wear-resistant and corrosion-resistant coating on a substrate when applied by a thermal spraying process. The coating exhibits desirable hardness, toughness, and bonding characteristics in a highly dense coating that is suitable for a wide range of temperatures. The embodiment provides a method of forming a coating, the method comprising: providing a substrate; and disposing onto the substrate a coating, comprising: a powder-containing composition comprising an alloy, the alloy comprising a solid solution comprising nickel, and a first component comprising at least one transition metal element and at least one nonmetal element.

6 Claims, 2 Drawing Sheets

(51) Int. Cl.
*C23C 4/10* (2016.01)
*C23C 4/067* (2016.01)

(52) U.S. Cl.
CPC ..... *Y10T 428/13* (2015.01); *Y10T 428/24997* (2015.04); *Y10T 428/31678* (2015.04)

(56) References Cited

U.S. PATENT DOCUMENTS

| | | | | |
|---|---|---|---|---|
| 4,439,236 | A * | 3/1984 | Ray | B22F 9/007 148/334 |
| 4,594,103 | A * | 6/1986 | Simm et al. | 420/452 |
| 4,609,401 | A * | 9/1986 | Simm et al. | 75/252 |
| 4,692,305 | A | 9/1987 | Rangaswamy et al. | |
| 4,892,628 | A * | 1/1990 | Guilinger | 205/243 |
| 4,903,170 | A * | 2/1990 | Finney et al. | 361/818 |
| 4,906,529 | A | 3/1990 | Brundbjerg et al. | |
| 5,126,104 | A | 6/1992 | Anand et al. | |
| 5,288,344 | A | 2/1994 | Peker | |
| 5,368,659 | A | 11/1994 | Peker | |
| 5,618,359 | A | 4/1997 | Lin | |
| 5,735,975 | A | 4/1998 | Lin | |
| 5,747,163 | A * | 5/1998 | Douglas | 428/404 |
| 6,325,868 | B1 | 12/2001 | Kim | |
| 8,480,864 | B2 | 7/2013 | Farmer et al. | |
| 2002/0166682 | A1* | 11/2002 | Watchko et al. | 174/35 R |
| 2004/0091385 | A1* | 5/2004 | Leyendecker | C22C 13/00 420/524 |
| 2005/0028900 | A1* | 2/2005 | Chu et al. | 148/561 |
| 2005/0166987 | A1 | 8/2005 | Matsubara et al. | |
| 2007/0107810 | A1* | 5/2007 | Farmer | 148/403 |
| 2007/0227299 | A1* | 10/2007 | Marchiando et al. | 75/244 |

FOREIGN PATENT DOCUMENTS

| | | | | |
|---|---|---|---|---|
| EP | 0223135 | | 5/1987 | |
| EP | 1736564 | A1 * | 12/2006 | B32B 15/01 |
| GB | 2009233 | | 6/1979 | |
| JP | 05195107 | A * | 8/1993 | |
| JP | 2001-303218 | | 10/2001 | |
| WO | 8500127 | | 1/1985 | |
| WO | WO 04/043123 | | 5/2004 | |

OTHER PUBLICATIONS

"Conversion Chart of Vickers Hardness (HV) to Rockwell C (HRC)", p. 1 Accessed on Mar. 11, 2014 athttp://www.taylorspecialsteels.co.uk/pages/main/conchart.htm.*

Wang, A.P.; Zhang, T.; Wang, J.Q.; "Ni-based fully amorphous metallic coating with high corrosion resistance", Philosophical Magazine Letters, 2006, p. 5-11.*

Jayaraj, J.; Sordelet, D.J.; Kim, D.H.; Kim, Y.C., Fleury, E.; "Corrosion behaviour of Ni—Zr—Ti—Si—Sn amorphous plasma spray coating", Corrosion Science. 2006, 48, 950-964.*

Gordon England, "Nature of Thermal Spray", p. 1-15, Accessed on Dec. 7, 2015 at http://www.gordonengland.co.uk/tsc.htm. Final page containing zoomed image from p. 12 of disclosure was added by examiner.*

Li, C.; Wang, Y.; Li, H.; "Effect of Nano-crystallization of High Velocity Oxy-fuel-sprayed Amorphous NiCrBSi Alloy on Properties of the Coatings", J. Vac. Sci. Technol. A; 2004, vol. 22, p. 2000-2004.*

Sauveur, A.; "The Metallography and Heat Treatmentr of Iron and Steel", 1916, p. 425.*

Oska, M.; Turunen, E.; Varis, T.; "Sealing of Thermally Sprayed HVOF Coatings for Boiler Applications" from Thermal Spray 2004 Advances in Technology and Application, 2004, p. 1-5.*

"Alloy", Hawley's Condensed Chemical Dictionary, 2007, p. 1-2.*

English language translation of text of JP05-195107A, generated with AIPN Japan Patent Office website (https://dossier1.j-platpat.inpit.go.jp/tri/all/odse/ODSE_GM101_Top.action) on Jun. 20, 2017.*

Inoue et al., "Bulk amorphous alloys with high mechanical strength and good soft magnetic properties in Fe—Tm—B (Tm=IV-VIII group transition metal) system", Appl. Phys. Lett., vol. 71, p. 464 (1997).

Shen et., "Bulk Glassy Co43Fe20Ta5.5B31.5 Alloy with High Glass-Forming Ability and Good Soft Magnetic Properties", Materials Transactions, vol. 42 No. 10 (2001) pp. 2136-2139.

International Preliminary Report on Patentability dated Aug. 16, 2012, for PCT/US2011/023395.

State Intellectual Property Office of the People's Republic of China, Chinese Office Action, Chinese patent application No. 201180013534.2, dated Dec. 24, 2013, total of 6 pages.

Korean Patent Office Action, Korean patent application No. 10-2012-7022981, dated Jan. 15, 2014, total of 6 pages.

Korean Patent Application No. 10-2012-7022981, Notice of Final Rejection, dated Jun. 26, 2014.

State Intellectual Property Office of the People's Republic of China, Application No. 201180013534.2, dated Sep. 12, 2014.

* cited by examiner

NICKEL BASED THERMAL SPRAY POWDER AND COATING, AND METHOD FOR MAKING THE SAME

RELATED APPLICATION

This application claims priority from U.S. Provisional Application Ser. No. 61/300,381, filed Feb. 1, 2010, which is hereby incorporated herein by reference in its entirety.

All publications, patents, and patent applications cited in this specification are hereby incorporated by reference in their entirety.

BACKGROUND

Thermal spraying process is generally referred to as a process that uses heat to deposit molten or semi-molten materials onto a substrate to protect the substrate from wear and corrosion. In a thermal spraying process the material to be deposited is supplied in a powder form, for example. Such powders could comprise small particles, e.g., between 100-mesh U.S. Standard screen size (149 microns) and about 2 microns.

A thermal spraying process generally includes three distinctive steps: the first step is to melt the material, the second is to atomize the material, and the third is to deposit the material onto the substrate. For example, an arc spraying process uses an electrical arc to melt the material and a compressed gas to atomize and deposit the material onto a substrate.

Materials known as hard facing alloys could be used for coatings produced, for example, by thermal spraying. Generally, the alloy coatings are used for hard surfacing to provide wear resistance, particularly where a desirable surface finish is desired. However, many coatings designed to operate at elevated temperatures and provide corrosion and wear properties often fail due to poor coating density, which leads to the corrosive products reaching the substrate and causing spalling. For example, composite coatings designed for wear protection often fail due to matrix erosion, leading to a loss of a composite hard phase. Accordingly, a need exists for improved materials to be used in thermal spray coatings.

SUMMARY

Provided in some embodiments includes methods of coating a substrate by a thermal spraying process with fully alloyed powders to form wear-resistant and corrosion-resistant coatings on the substrate and the coatings as a result of the presently described methods.

One embodiment provides a coating comprising: a powder-containing composition comprising an alloy, the alloy comprising a solid solution phase comprising nickel, and a first component phase comprising at least one transition metal element and at least one nonmetal element.

An alternative embodiment provides a powder-containing composition, comprising an alloy, represented by the formula: $(Ni_xCr_y)_a(M_bN_c)$, wherein: M represents a transition metal element in a first component phase; N represents a nonmetal element in the first component phase; a, b, and c each is greater than 0 and independently represents a weight percentage; and x and y each is greater than 0 and independently represents a weight percentage of a Ni-containing solid solution phase. In some embodiments, a is from about 85 to 95, b is from about 0.1 to 10, c is from about 5 to 10, and the ratio of x and y is between 0.5 to 1.9.

One embodiment provides a method of forming a coating, the method comprising: providing a substrate; and disposing onto the substrate a coating, comprising: a powder-containing composition comprising an alloy, the alloy comprising a solid solution phase comprising nickel, and a first component phase comprising at least one transition metal element and at least one nonmetal element.

Another embodiment provides a method of forming a coating, comprising: providing a mixture, comprising nickel, at least one transition metal element that is not nickel, and at least one nonmetal element; forming the mixture into a powder-containing composition, wherein the composition comprises an alloy, the alloy comprising a solid solution phase comprising the nickel, and a first component phase comprising the transition metal element and the nonmetal element; and disposing the powder-containing composition onto a substrate to form the coating.

An alternative embodiment provides a method of forming a coating, the method comprising: disposing onto a substrate a coating, comprising: a powder-containing composition comprising an alloy, which is represented by the formula: $(Ni_xCr_y)_a(M_bN_c)$ wherein: M represents a transition metal element in a first component phase; N represents a nonmetal element in the first component phase; a, b, and c each independently represents a weight percentage; x and y each independently represents a weight percentage of a nickel-containing solid solution phase; and (i) a is from about 85 to about 95, (ii) b is from about 0.1 to about 10, (iii) c is from about 5 to about 10, and (iv) a ratio of x to y is between about 0.5 to about 1.9.

DETAILED DESCRIPTION

Figure 1:
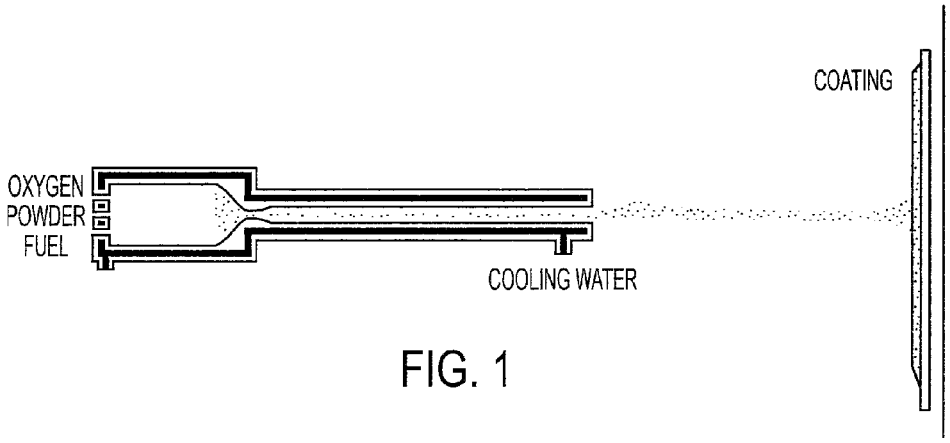
FIG. 1 shows a schematic diagram of the high velocity oxygen fuel (HVOF) process.

One embodiment provides a coating, which includes a powder-containing composition having an alloy, the alloy having a solid solution phase comprising nickel, and a first component phase comprising at least one transition metal element and at least one nonmetal element. The composition can be applied to a substrate to form a coating. In one embodiment, the alloy can be represented by the formula: $(Ni_xCr_y)_a(M_bN_c)$, wherein: M represents the transition metal element in the first component phase; N represents the nonmetal element in the first component phase; a, b, and c each is greater than 0 and independently represents a weight percentage; and x and y each is greater than 0 and independently represents a weight percentage of the Ni—Cr solid solution phase. In one embodiment, a can be from about 85 to 95, b can be from about 0.1 to 10, c can be from about 5 to 10, and the ratio of x and y can be between 0.5 to 1.9.

Powder-Containing Composition

The term "powder-containing composition" refers to any composition containing a powder therein. The term "powder" refers to a substance containing ground, pulverized, or otherwise finely dispersed solid particles.

Phase

The term "phase" herein can refer to one that can be found in a thermodynamic phase diagram. A phase is a region of space (a thermodynamic system) throughout which all physical properties of a material are essentially uniform. Examples of physical properties include density, index of refraction, chemical composition and lattice periodicity. A simple description is that a phase is a region of material that is chemically uniform, physically distinct, and (often) mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound.

While the alloyed powder-containing composition described herein can be of a single phase, it is desirable to have the composition be of multi-phased. For example, the composition can have at least two phases, at least three phases, at least four phases, or more. In one embodiment, the alloy composition can include a metal solution phase and an additional phase that can be another metal solution phase or a phase that is not a metal solution. For example, this additional phase can be a compound phase. The metal solution phase can be any type of metal solution, depending on the chemistry of the solution. For example, it can be a metal-based solution, the metal being a transition metal, such as nickel. In one embodiment, the metal-solution can include a nickel-chromium (Ni—Cr) metal solution.

The second phase can be, for example, a compound phase. The compound can be a binary compound, tertiary compound, quaternary compound, or a compound having more than four elements. As referred to in the formula above, the compound can be a metal-nonmetal compound (e.g., MN). M can represent a metal, such as, for example, a transition metal, whereas N can represent a nonmetal. As also described above, the compound can have multiple M and/or N. In one embodiment, depending on the chemical composition, particularly on the N, the additional phase can be, for example, a carbide, a boride, or both. Accordingly, the second phase can be a carbide compound and a third phase, if present, can be a boride compound, or vice versa. Alternatively, the second and third phase can be carbides or borides. In one embodiment, the additional phase(s) can include the compounds nickel boride, chromium carbide, chromium boride, or combinations thereof.

Metal, Transition Metal and Non-Metal

The term "metal" refers to an electropositive chemical element. The term "element" in this specification refers generally to an element that can be found in a Periodic Table. Physically, a metal atom in the ground state contains a partially filled band with an empty state close to an occupied state. Chemically, upon going into solution a metal atom releases an electron to become a positive ion. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

The symbol N represents one or more nonmetal elements. Depending on the application, any suitable nonmetal elements, or their combinations, can be used. The alloy composition can comprise multiple nonmetal elements, such as at least two, at least three, at least four, or more, nonmetal elements. In that case, the symbol "N" represents and includes multiple nonmetal elements, and the chemical formula can have $N_1$, $N_2$, $N_3$, etc. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy composition can comprise a boride, a carbide, or both.

The symbol M represents one or more transitional metal elements. For example, M can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, ununbium. In one embodiment, M can represent at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements. In that case, the symbol "M" represents and includes multiple transitional metal elements, and the chemical formula can have $M_1$, $M_2$, $M_3$, etc. In one embodiment, the transition metal elements comprise Fe, Ti, Zr, or combinations thereof.

The alloy in the powder-containing composition can be any shape or size. For example, the alloy can have a shape of a particulate, which can have a shape such as spherical, ellipsoid, wire-like, rod-like, sheet-like, flake-like, or an irregular shape. The particulate can have any suitable size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and 40 microns, such as between about 25 microns and 35 microns. In some embodiments, smaller particulates, such as those in the nanometer range, or larger particulates, such as those bigger than 100 microns, can be used.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloyed powder-containing composition described herein can be fully alloyed. An "alloy" refers to a homogeneous mixture or solid solution of two or more metals, the atoms of one replacing or occupying interstitial positions between the atoms of the other, for example, brass is an alloy of zinc and copper. An alloy, as opposed to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that transforms into a liquid upon heating through the glass transition. Other types of amorphous solids include gels, thin films, and nanostructured materials. Generally, amorphous materials lack the long-range order characteristic of a crystal though they possess some short-range order at the atomic length scale due to the nature of chemical bonding. The distinction between amorphous solids and crystalline solids can be made based on lattice periodicity that can be determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true except, for example, in quasicrystals that have perfectly deterministic tilings but do not possess lattice periodicity.

Long-range order characterizes physical systems in which remote portions of the same sample exhibit correlated behavior.

This can be expressed as a correlation function, namely the spin-spin correlation function: $G(x, x')=(s(x), s(x'))$.

In the above function, s is the spin quantum number and x is the distance function within the particular system.

This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$ then the system is said to possess long-range order. If it decays to zero as a power of the distance then it is called quasi-long-range order. Note that what constitutes a large value of $|x-x'|$ is relative.

A system is said to present quenched disorder when some parameters defining its behavior are random variables which do not evolve with time, i.e., they are quenched or frozen, for example, spin glasses. It is opposite to annealed disorder, where the random variables are allowed to evolve themselves. Embodiments herein include systems comprising quenched disorder.

The alloyed powder-containing composition described herein can be crystalline, partially crystalline, amorphous, or substantially amorphous. For example, the alloyed powder can include at least some crystallinity, with grains/crystals having sizes in the nanometer and/or micrometer ranges. Alternatively, the alloyed powder can be substantially amorphous, such as fully amorphous. In one embodiment, the alloyed powder-containing composition is at least substantially not amorphous, such as being substantially crystalline, such as being entirely crystalline.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. An "amorphous metal" is an amorphous metallic material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are called "glasses," and so amorphous metals are commonly referred to as "metallic glasses" or "glassy metals." However, there are several ways besides extremely rapid cooling in which amorphous metals can be produced, including physical vapor deposition, solid-state reaction, ion irradiation, melt spinning, and mechanical alloying. Amorphous alloys are a single class of materials, regardless of how they are prepared.

Amorphous metals can be produced through a variety of quick-cooling methods. For instance, amorphous metal can be produced by sputtering molten metal onto a spinning metal disk. The rapid cooling, on the order of millions of degrees a second, is too fast for crystals to form and the material is "locked in" a glassy state. Also, amorphous metals can be produced with critical cooling rates low enough to allow formation of amorphous structure in thick layers (over 1 millimeter); these are known as bulk metallic glasses (BMG).

Amorphous metal can be an alloy rather than a pure metal. The alloys may contain atoms of significantly different sizes, leading to low free volume (and therefore up to orders of magnitude higher viscosity than other metals and alloys) in molten state. The viscosity prevents the atoms from moving enough to form an ordered lattice. The material structure may result in low shrinkage during cooling and resistance to plastic deformation. The absence of grain boundaries, the weak spots of crystalline materials may lead to better resistance to wear and corrosion. Amorphous metals, while technically glasses, may also be much tougher and less brittle than oxide glasses and ceramics.

Thermal conductivity of amorphous materials may be lower than that of crystals. To achieve formation of an amorphous structure even during slower cooling, the alloy may be made of three or more components, leading to complex crystal units with higher potential energy and lower chance of formation. The formation of amorphous alloy depends on several factors: the composition of the components of the alloy; the atomic radius of the components has to be significantly different (over 12%), to achieve high packing density and low free volume; the combination of components should have negative heat of mixing, inhibiting crystal nucleation and prolonging the time the molten metal stays in a supercooled state. However, as the formation of an amorphous alloy is based on many different variables, it is almost impossible to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which does not have any of the defects (such as dislocations) that limit the strength of crystalline alloys. One modern amorphous metal, known as Vitreloy, has a tensile strength that is almost twice that of high-grade titanium. However, metallic glasses at room temperature are not ductile and tend to fail suddenly when loaded in tension, which limits the material applicability in reliability-critical applications, as the impending failure is not evident. Therefore, there is considerable interest in producing metal matrix composite materials consisting of a metallic glass matrix containing dendritic particles or fibers of a ductile crystalline metal.

Another useful property of bulk amorphous alloys is that they are true glasses, which means that they soften and flow upon heating. This allows for easy processing, such as by injection molding, in much the same way as polymers. As a result, amorphous alloys can be used for making sports equipment, medical devices, electronic components and equipment, and thin films. Thin films of amorphous metals can be deposited via high velocity oxygen fuel technique as protective coatings.

An amorphous metal or amorphous alloy can refer to a metal-element-containing material exhibiting only a short range order—the term "element" throughout this application refers to the element found in a Periodic Table. Because of the short-range order, an amorphous material can sometimes be described as "glassy." Thus, as explained above, an amorphous metal or alloy can sometimes be referred to as "metallic glass," or "Bulk Metallic Glass" (BMG).

A material can have an amorphous phase, a crystalline phase, or both. The amorphous and crystalline phases can have the same chemical composition and differ only in the microstructure—i.e., one amorphous and the other crystalline. Microstructure is defined as the structure of a material as revealed by a microscope at 25× magnification. Alternatively, the two phases can have different chemical compositions and microstructure. For example, a composition can be partially amorphous, substantially amorphous, or completely amorphous. A partially amorphous composition can refer to a composition at least about 5 vol % of which is of an amorphous phase, such as at least about 10 wt %, such as at least 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or different chemical composition. In one embodiment, they have substantially the same chemical composition.

The methods described herein can be applicable to any type of amorphous alloys. Similarly, the amorphous alloys described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, or combinations thereof. Namely, the alloy can include any combination of these elements in its chemical formula or chemical composition. The elements can be present at different weight or volume percentages. For example, an iron "based" alloy can refer to an alloy having a non-significant weight percentage of iron present therein, the weight percent can be, for example, at least about 10 wt %, such as at least about 20 wt %, such as at least about 40 wt %, such as at least about 50 wt %, such as at least about 60 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. In some embodiments, the alloy, or the composition including the alloy, can be substantially free of nickel, aluminum, or beryllium, or combinations thereof. In one embodiment, the alloy or the composite is completely free of nickel, aluminum, or beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy, such as Vitreloy-1 and Vitreloy-101, as fabricated by Liquidmetal Technologies, Calif., USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein are disclosed US 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |

TABLE 1-continued

Exemplary amorphous alloy compositions

| Alloy | Atm % | Atm % | Atm % | Atm % | Atm % | Atm % |
|---|---|---|---|---|---|---|
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

The aforedescribed amorphous alloy systems can further include additional elements, such as additional transition metal elements, including Nb, Cr, V, Co. The additional elements can be present at less than or equal to about 30 wt %, such as less than or equal to about 20 wt %, such as less than or equal to about 10 wt %, such as less than or equal to about 5 wt %.

In some embodiments a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the composition consists essentially of the amorphous alloy (with only small incidental amount of impurities). In another embodiment, the composition consists of the amorphous alloy (with no observable trace of impurities).

Amorphous alloy systems can exhibit several desirable properties. For example, they can have a high hardness and/or hardness; a ferrous-based amorphous alloy can have particularly high yield strength and hardness. In one embodiment, an amorphous alloy can have a yield strength of about 200 ksi or higher, such as 250 ksi or higher, such as 400 ksi or higher, such as 500 ksi or higher, such as 600 ksi or higher. With respect to the hardness, in one embodiment, amorphous alloys can have a hardness value of above about 400 Vickers-100 mg, such as above about 450 Vickers-100 mg, such as above about 600 Vickers-100 mg, such as above about 800 Vickers-100 mg, such as above about 1000 Vickers-100 mg, such as above about 1100 Vickers-100 mg, such as above about 1200 Vickers-100 mg. An amorphous alloy can also have a very high elastic strain limit, such as at least about 1.2%, such as at least about 1.5%, such as at least about 1.6%, such as at least about 1.8%, such as at least about 2.0%. Amorphous alloys can also exhibit high strength-to weight ratios, particularly in the case of, for example, Ti-based and Fe-based alloys. They also can have high resistance to corrosion and high environmental durability, particularly, for example, the Zr-based and Ti-based alloys.

Chemical Compositions

Depending on the processes involved and the applications desired, the chemical composition of the alloyed powder-containing composition can be varied. For example, in one embodiment, the composition can have three phases, with one being a solid solution phase, and the two remaining phases being other component phases, e.g., a first component phase and a second component phase. The second component phase, for example, can be the same as or different from the first component phase in terms of chemical composition. In one embodiment, the second component phase includes at least one transition metal element and at least one nonmetal element, either of which elements can be the same as or different from those in the first component phase. The elements can also be present at any desirable amount. For example, in one embodiment, the transition metal element can be less than or equal to about 20 wt % of the overall alloy composition, such as less than or equal to about 15 wt %, such as less than or equal to about 10 wt %, such as less than or equal to about 5 wt %.

In another embodiment, the alloyed powder can also have three phases, but different from the ones described above. The powder can have from about 0.01 to about 20 wt %, such as from about 0.05 to about 15 wt %, such as from about 0.1 to about 10 wt % of one or more transition metals (i.e., M); from about 1 to about 20 wt %, such as from about 2 to about 15 wt %, such as from about 5 to about 10 wt % of at least one nonmetallic element (i.e., N); and a balance of Ni and Cr, where the weight ratio of Ni and Cr is from about 0.1 to about 2.5, such as from about 0.5 to about 1.9, such as from about 0.6 to about 1.5. A composition including the alloyed powder-containing composition can consist essentially of the alloyed powder-containing composition, as the chemical composition can also contain some small amount of impurities. The amount of impurities can be, for example, less than 10 wt %, such as less than 5 wt %, such as less than 2 wt %, such as less than 1 wt %, such as less than 0.5 wt %, such as less than 0.2 wt %, such as less than 0.1 wt %. In one embodiment, the chemical composition can consist of the alloyed powder-containing composition.

When the alloyed powder-containing composition is used to fabricate a product, such as a coating, additional materials can be optionally added. For example, in one embodiment wherein the alloyed powder is used to fabricate a coating on a substrate, some optional elements can be added in a small amount, such as less than 15 wt %, such as less than 10 wt %, such as less than 5 wt %. These elements can include, for example, cobalt, manganese, zirconium, tantalum, niobium, tungsten, yttrium, titanium, vanadium, hafnium, or combinations thereof. These elements, alone or in combination, can form compounds, such as carbides, to further improve wear and corrosion resistance.

Some other optional elements can be added to modify other properties of the fabricated coating. For example, elements such as phosphorous, germanium, arsenic, or combinations thereof, can be added to reduce the melting point of the composition. These elements can be added in a small amount, such as less than 10 wt %, such as less than 5 wt %, such as less than 2 wt %, such as less than 1 wt %, such as less than 0.5 wt %.

In one embodiment, the formulation of the alloy can be represented by the following formula: $(Ni_xCr_y)_aM_bN_c$, wherein: N is selected from the group consisting of one or more nonmetallic elements including B, Si, C, P; M is selected from the group consisting of one or more transition metal elements; and x, y, a, b, and c are in weight percentages wherein:

a is from about 85 to about 95, b is from about 0.1 to about 10, c is from about 5 to about 10, and the ratio of x and y is between about 0.5 and about 1.9.

In an alternative embodiment M is Fe, and N includes at least two nonmetallic elements.

In an alternative embodiment M is Fe, and N includes at least three nonmetallic elements.

In an alternative embodiment M is Fe, and N are B, Si, and C.

In an alternative embodiment M is Ti, and N includes at least two nonmetallic elements.

In an alternative embodiment M is Ti, and N includes at least three nonmetallic elements.

In an alternative embodiment M is Ti, and N are B, Si, and C.

In an alternative embodiment M is Zr, and N includes at least two nonmetallic elements.

In an alternative embodiment M is Zr, and N includes at least three nonmetallic elements.

In an alternative embodiment M is Zr, and N are B, Si, and C.

In an alternative embodiment the coating mixture was pre-alloyed and processed into a powdered form of the mixture.

In an alternative embodiment second and third phase components include one or more of the following compounds: NiB, CrC, CrB.

In an alternative embodiment, an at least substantially fully alloyed powder can have a formula of: $(Ni_xCr_y)_aFe_bN_c$, which has the same weight percentages as described above, wherein N includes at least two or at least three nonmetallic elements. In one such embodiment, the three nonmetallic elements are B, Si and C.

In another embodiment, an at least substantially fully alloyed powder can have a formula of: $(Ni_xCr_y)_aTi_bN_c$, which has the same weight percentages as described above, wherein N includes at least two or at least three nonmetallic elements. In one such embodiment, the three nonmetallic elements are B, Si and C.

In another embodiment, an at least substantially fully alloyed powder can have a formula of: $(Ni_xCr_y)_aZr_bN_c$, which has the same weight percentages as described above, wherein N includes at least two or at least three nonmetallic elements. In one such embodiment, the three nonmetallic elements are B, Si and C.

In one exemplary embodiment, the alloyed powder-containing composition comprises about 33-37 wt % Cr, about 3-3.5 wt % Si, about 4-4.5 wt % B, about 48-54 wt % Ni, about 1 wt % C, and a balance of Fe. Alternatively, in some compositions, some Cr can be replaced by other materials, such as Ti. In one such embodiment, the alloyed powder-containing composition comprises about 33-35 wt % Cr, about 1-2 wt % Ti, about 3.3-3.5 wt % Si, about 4-4.5 wt % B, about 48-54 wt % Ni, about 1 wt % C, and a balance of Fe. In addition, in some embodiments up to about 5 wt % Nb, such as up to about 4 wt % Nb, such as up to about 3 wt % Nb, such as up to about 2 wt % Nb, can be added with a proportionate reduction of Ni. Optionally, the composition could have Zr instead of Fe.

Coating

The term "coating" refers to a covering, e.g., a layer of material, which is applied to the surface of an object, usually referred to as the substrate. In one embodiment, the alloyed powder-containing composition is applied onto a substrate to form a coating. The substrate can be of any type of suitable substrate, such as a metal substrate, a ceramic substrate, or a combination thereof. Because of the properties of the presently described alloyed powder-containing composition, a coating made therefrom can have superior properties. For example, the coating can have high hardness. In one embodiment, the coating can have a Vickers hardness of at least about 300 HV-100 gm, such as at least about 450 HV-100 gm, such as at least about 500 HV-100 gm, such as at least about 600 HV-100 gm.

The coating are wear-resistant and/or corrosion resistant. Corrosion is the disintegration of an engineered material into its constituent atoms due to chemical reactions with its surroundings. This means electrochemical oxidation of metals in reaction with an oxidant such as oxygen. Formation of an oxide of a metal due to oxidation of the metal atoms in solid solution is an example of electrochemical corrosion termed rusting. This type of damage typically produces oxide(s) and/or salt(s) of the original metal. Corrosion can also refer to other materials than metals, such as ceramics or polymers, although in this context, the term degradation is more common. In other words, corrosion is the wearing away of metals due to a chemical reaction.

Metals and alloys could corrode merely from exposure to moisture in the air, but the process can be strongly affected by exposure to certain substances such as salts. Corrosion can be concentrated locally to form a pit or crack, or it can extend across a wide area more or less uniformly corroding the surface. Because corrosion is a diffusion controlled process, it occurs on exposed surfaces. As a result, methods to reduce the activity of the exposed surface, such as a coating, passivation and chromate-conversion, can increase a material's corrosion resistance.

The term "corrosion resistant" in the context of the coatings of the embodiments herein means that a material having a coating has a substantially less corrosion when exposed to an environment than that the same material without the coating that is exposed to the same environment.

The coating fabricated from the presently described alloyed powder-containing composition can exhibit desirable hardness, toughness, and bonding characteristics. The coating can also be fully dense and suitable for very wide temperature ranges encountered in power utility boilers. The coating can be at least partially amorphous, such as substantially amorphous or fully amorphous. For example, the coating can have at least 50% of its volume being amorphous, such as at least 60%, such as at least 80%, such as at least 90%, such as at least 95%, such as at least 99%, being amorphous.

The coating produced by the methods and compositions described herein can be dense. For example, it can have less than or equal to about 10% (volume) of porosity, such as less than or equal to about 5% of porosity, such as less than or equal to about 2% of porosity, such as less than or equal to about 1% of porosity, such as less than or equal to about 0.5% of porosity. Depending on the context, the aforedescribed percentages can be weight percentages, instead of volume percentages. Typical thickness of the coating could be from about 0.001" to about 0.1", preferably about 0.005" to about 0.05", and most preferably from about 0.010" and about 0.030".

Alloys having the presently described compositions, particularly those in a coating form, such as those produced by a welding or thermal spray process, can be surprisingly low in oxide content, even when prepared in air. They have a combination of resistance to abrasive wear, adhesive (sliding) wear and corrosion, which can be particularly useful. One exemplary coating can have about 33-37 wt % Cr, about 3-3.5 wt % Si, about 4-4.5 wt % B, about 48-54 wt % Ni, about 1 wt % C, and a balance of Fe.

The coating can include any of the alloyed powder-containing composition as described above. In addition to the alloyed powder-containing composition, the coating can include additional elements or materials, such as those from a binder. The term "binder" refers to a material used to bind other materials. The coating can also include any additives intentionally added or incidental impurities. In one embodiment, the coating consists essentially of the alloyed powder-containing composition, such as consisting of the alloyed powder-containing composition.

Because of the superior mechanical properties and resistance to corrosion, the presently described coating can be used in a variety of applications. For example, the coatings can be used as bearing and wear surfaces, particularly where there are corrosive conditions. The coating can also be used, for example, for coating yankee dryer rolls; automotive and diesel engine piston rings; pump components such as shafts, sleeves, seals, impellers, casing areas, plungers; Wankel engine components such as housing, end plate; and machine elements such as cylinder liners, pistons, valve stems and hydraulic rams. The coating is a part of a yankee dryer, an engine piston; pump shaft, pump sleeve, pump seal, pump impeller, pump casing, pump plunger, component, Wankel engine, engine housing, engine end plate, industrial machine, machine cylinder liners, machine pistons, machine valve stems, machine hydraulic rams, or combinations thereof. The coating can also be used in any consumer electronic devices, such as cell phones, desktop computers, laptop computers, and/or portable music players. An electronic device is described further below.

Furthermore, there are several advantages the coatings of the embodiments herein. For example, the coating will retain its integrity without falling off of the hard particulates. In addition, it can withstand high temperature, and could be more ductile, fatigue resistant than conventional coatings.

Coating Method

In one embodiment, the method of forming such a coating can include disposing a coating comprising onto a substrate. In one embodiment, the method can further include steps of making the alloyed powder-containing composition. Various techniques can be used to fabricate the alloyed powder-containing composition. One such technique is atomization.

Atomization is one way of putting the coatings of the embodiments herein. One example of atomization can be gas atomization, which can refer to a method of whereby molten metal is broken up into smaller particles by a rapidly moving inert gas stream. The gas stream can include non-reactive gas(s), such as inert gases including argon or nitrogen. While the various constituents can be physically mixed or blended together before coating, in some embodiments, atomization, such as a gas atomization, is preferred.

In one embodiment, the method of coating, including the steps of forming the alloyed powder-containing composition can include providing a mixture, comprising nickel, at least one transition metal element that is not nickel, and at least one nonmetal element; forming the mixture into a powder-containing composition, wherein the composition comprises an alloy, the alloy comprising a solid solution phase comprising the nickel, and a first component phase comprising the transition metal element and the nonmetal element; and disposing the powder-containing composition onto a substrate to form the coating. The composition can be any of the aforedescribed composition. The mixture of the various elements, including nickel, can be pre-mixed, or they can be mixed in an additional step. The elements in the mixture can include any of the elements of the alloyed powder-containing composition.

The alloyed powder-containing composition can then be disposed onto a substrate. Any suitable disposing techniques can be used. For example, thermal spraying can be used. A thermal spraying technique can include cold spraying, detonation spraying, flame spraying, high-velocity oxy-fuel coating spraying (HVOF), plasma spraying, warm spraying, wire arc spraying, or combinations thereof. The thermal spray can be carried out in one or more steps of operation.

Thermal spraying can refer to a coating process in which melted (or heated) materials are sprayed onto a surface. The "feedstock" (coating precursor) can be heated by, for example, electrical (plasma or arc) or chemical means (combustion flame). Thermal spraying can provide thick coatings (e.g., thickness range of about 20 micrometers or more, such as to the millimeter range) over a large area at high deposition rate, as compared to other coating processes. The feedstock can be fed into the system in powder or wire form, heated to a molten or semimolten state, and then accelerated towards substrates in the form of micrometer-size particles. Combustion or electrical arc discharge can be used as the source of energy for thermal spraying. Resulting coatings can be made by the accumulation of numerous sprayed particles. Because the surface may not heat up significantly, thermal spray coating can have an advantage of allowing coating of flammable substances.

The composition can include any of the aforementioned alloyed powder-containing compositions. The disposing step can be carried out via any suitable techniques, such as spraying, such as thermal spraying. The presently described alloyed powder-containing compositions can be used in a number of (fully or substantially fully) alloyed forms, such as cast, sintered, or welded forms, or as a quenched powder or ribbon. The composition can be especially suitable for application as a coating produced by thermal spraying. Any type of thermal spraying, such as plasma, flame, arc-plasma, arc and combustion, and High Velocity Oxy-Fuel (HVOF) spraying, can be used. In one embodiment, a high velocity thermal spraying process, such as HVOF, is used.

Figure 2:
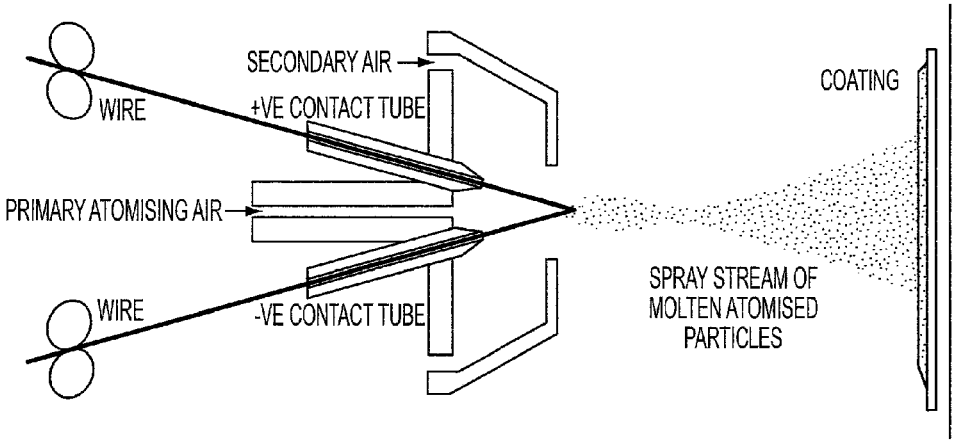
FIG. 2 shows a schematic diagram of arc wire thermal spray process.

An embodiment of the HVOF process is shown in FIG. 2. The HVOF thermal spray process is substantially the same as the combustion powder spray process (LVOF) except that this process has been developed to produce extremely high spray velocity. There are a number of HVOF guns which use different methods to achieve high velocity spraying. One method is basically a high pressure water cooled combustion chamber and long nozzle. Fuel (kerosene, acetylene, propylene and hydrogen) and oxygen are fed into the chamber, combustion produces a hot high pressure flame which is forced down a nozzle increasing its velocity. Powder may be fed axially into the combustion chamber under high pressure or fed through the side of laval type nozzle where the pressure is lower. Another method uses a simpler system of a high pressure combustion nozzle and air cap. Fuel gas (propane, propylene or hydrogen) and oxygen are supplied at high pressure, combustion occurs outside the nozzle but within an air cap supplied with compressed air. The compressed air pinches and accelerates the flame and acts as a coolant for the gun. Powder is fed at high pressure axially from the centre of the nozzle.

In HVOF, a mixture of gaseous or liquid fuel and oxygen is fed into a combustion chamber, where they are ignited and combusted continuously. The resultant hot gas at a pressure close to 1 MPa emanates through a converging-diverging nozzle and travels through a straight section. The fuels can be gases (hydrogen, methane, propane, propylene, acetylene, natural gas, etc.) or liquids (kerosene, etc.). The jet velocity at the exit of the barrel (>1000 m/s) exceeds the speed of sound. A powder feed stock is injected into the gas stream, which accelerates the powder up to 800 m/s. The stream of hot gas and powder is directed towards the surface to be coated. The powder partially melts in the stream, and deposits upon the substrate. The resulting coating has low porosity and high bond strength.

HVOF coatings may be as thick as 12 mm (½"). It is typically used to deposit wear and corrosion resistant coatings on materials, such as ceramic and metallic layers. Common powders include WC—Co, chromium carbide, MCrAlY, and alumina. The process has been most successful can be used for depositing cermet materials (WC—Co, etc.) and other corrosion-resistant alloys (stainless steels, nickel-based alloys, aluminum, hydroxyapatite for medical implants, etc.).

Another method of making the coatings of the embodiments herein is by an arc wire thermal spray process shown in FIG. 2. In the arc spray process a pair of electrically conductive wires are melted by means of an electric arc. The molten material is atomized by compressed air and propelled towards the substrate surface. The impacting molten particles on the substrate rapidly solidify to form a coating. This process carried out correctly is called a "cold process" (relative to the substrate material being coated) as the substrate temperature can be kept low during processing avoiding damage, metallurgical changes and distortion to the substrate material.

Figure 3:
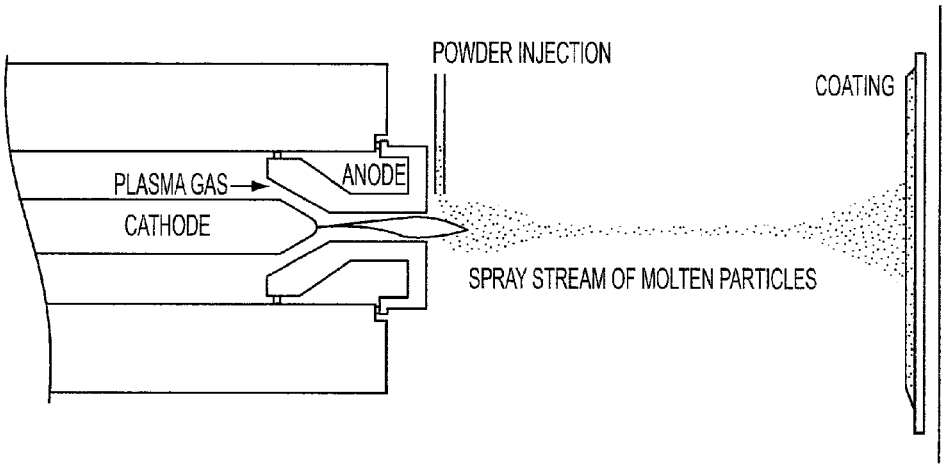
FIG. 3 shows a schematic diagram of a plasma thermal spray process.

Yet another method of making the coatings of the embodiments herein is by a plasma thermal spray process shown in FIG. 3. The plasma spray process is substantially the spraying of molten or heat softened material onto a surface to provide a coating. Material in the form of powder is injected into a very high temperature plasma flame, where it is rapidly heated and accelerated to a high velocity. The hot material impacts on the substrate surface and rapidly cools forming a coating. This process carried out correctly is called a "cold process" (relative to the substrate material being coated) as the substrate temperature can be kept low during processing avoiding damage, metallurgical changes and distortion to the substrate material.

The plasma gun comprises a copper anode and tungsten cathode, both of which are water cooled. Plasma gas (argon, nitrogen, hydrogen, helium) flows around the cathode and through the anode which is shaped as a constricting nozzle. The plasma is initiated by a high voltage discharge which causes localized ionization and a conductive path for a DC arc to form between cathode and anode. The resistance heating from the arc causes the gas to reach extreme temperatures, dissociate and ionize to form a plasma. The plasma exits the anode nozzle as a free or neutral plasma flame (plasma which does not carry electric current) which is quite different to the plasma transferred arc coating process where the arc extends to the surface to be coated. When the plasma is stabilized and ready for spraying the electric arc extends down the nozzle, instead of shorting out to the nearest edge of the anode nozzle. This stretching of the arc is due to a thermal pinch effect. Cold gas around the surface of the water cooled anode nozzle being electrically non-conductive constricts the plasma arc, raising its temperature and velocity. Powder is fed into the plasma flame most commonly via an external powder port mounted near the anode nozzle exit. The powder is so rapidly heated and accelerated that spray distances can be in the order of 25 to 150 mm.

In one embodiment wherein the composition is used as a thermal spray material, the composition is desirably in an alloy form (as opposed to a composite of the constituents). Not to be bound to any particular theory, but desirable effects can be obtained during thermal spraying when the homogeneity of the sprayed composition is maximized—i.e., as an alloy, as opposed to a composite. In fact, alloyed powder of size and flowability suitable for thermal spraying can provide such a venue of homogeneity maximization. The powder particle can take any shape, such as spherical particles, elliptical particles, irregular shaped particles, or flakes, such as flat flakes. In one embodiment, the alloyed powder can have a particle size that falls in a range between 100-mesh (U.S. standard screen size—i.e., 149 microns) and about 2 microns. Furthermore, the thermal spray material may be used as is or, for example, as a powder blended with at least one other thermal spray powder, such as tungsten carbide.

In some embodiments, the powder-containing composition used as a part of thermal spray material is desirable fully alloyed, or at least substantially alloyed. Thus, the process can further include a step of pre-alloying and processing at least some of the alloyed powder-containing composition into a powder form prior to the step of disposing. The alloyed powder-containing composition need not be in an amorphous form. The composition, for example, can have at least some crystallinity, such as being fully crystalline, or can be at least partially amorphous, such as substantially amorphous or fully amorphous. Not to be bound by any particular theory, but some of crystallinity can arise from the normal cooling rates in the pre-existing alloyed powder production procedures. In other words, the thermal spray powder may be made by such standard methods as atomizing from the melt and cooling the droplets under ambient condition, such as in air. In one embodiment, the alloyed powder can be manufactured by a method, such as atomization using non-reactive gases such as Argon or Nitrogen. Using such methods has been shown to develop secondary phases within the alloy. The thermal spraying can then melt the particles, which can quench on a surface being coated, thereby providing a coating that may be substantially or entirely amorphous.

By using the manufacturing procedures disclosed herein, the production of the thermal spray alloyed powder can be kept relatively simple and costs minimized. The method described herein can have an advantage of being used to form a composite powder coating as an outer sheath around a core of additional materials, including a cermet type material that does not alloy upon spraying. During the process, the powder may be sprayed using a conventional technique, such as with a powder-type thermal spray gun. Alternatively, it is also possible to combine the same into a composite wire or rod using plastic or a similar binder, which can decompose in the heating zone of the gun. A binder can be, for example, polyethylene or polyurethane. Alloy rods or wires may also be used in the wire thermal spraying process. In one embodiment, the rods or wires can have sizes and accuracy tolerances for flame spray wires, and thus, for example, may vary in size between 6.4 mm and 20 gauge.

Example

Figure 4:
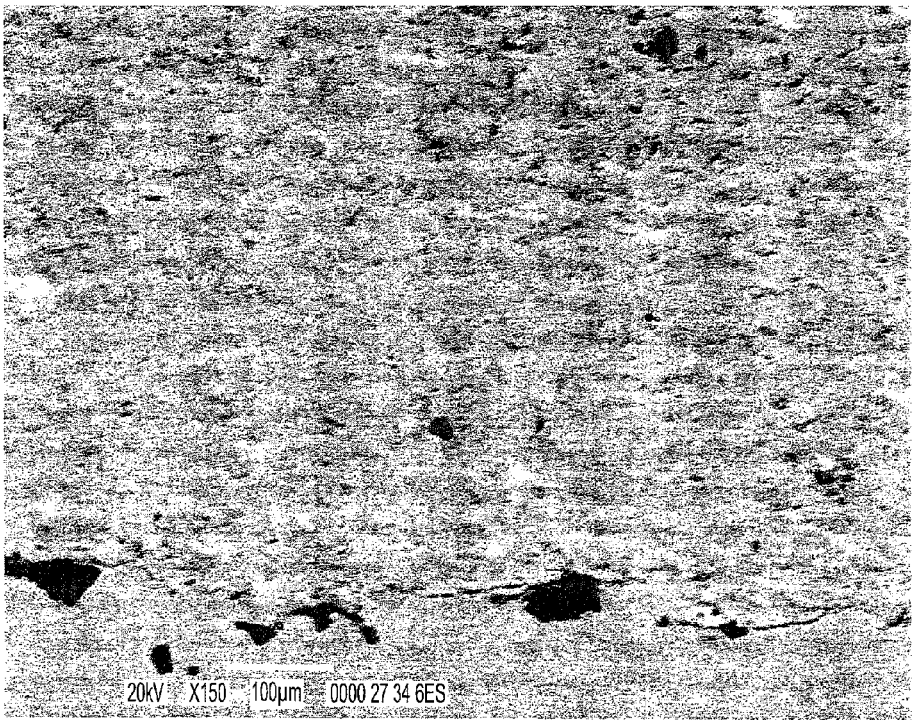
FIG. 4 shows a SEM micrograph of a cross section of a coating according to an embodiment.

A coating of nickel based alloy was deposited on a metallic substrate. The coating sample was made using the Nickel base powder applied by HVOF. The composition of the coating was approximately: 35Cr, 53Ni, 3.3Si, 4.5B, 0.9C with some included oxides from the high temperature spraying. The coating was analyzed and here are some data for the Nickel base coating: hardness (microhardness) 600-850 HV 100 mg load (the hardness range is due to the multiphase structure); DSC melting point was 2050° F.; X-ray diffraction showed a crystalline structure in a multiphase structure. The SEM image of a cross-section of the coating sample is shown in FIG. 4, which shows a multiphase structure.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Applications of Embodiments

Alternatively, it can be a part of an electronic device, such as, for example, a part of the housing of the device or an electrical interconnector thereof. For example, in one embodiment, the interfacial layer or seal can be used to connect and bond two parts of the housing of an electronic device and create a seal that is impermeable to fluid, effectively rendering the device water proof and air tight such that fluid cannot enter the interior of the device.

An electronic device herein can refer to any electronic device. For example, it can be a telephone, such as a cell phone, and/or a land-line phone, or any communication devices, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard driver tower housing or casing, laptop housing, laptop keyboard, laptop track pad, desktop keyboard, mouse, and speaker. The coating can also be applied to a device such as a watch or a clock.

What is claimed:

1. A coating comprising:

an alloy, the alloy comprising a solid solution and a first component, wherein:

the solid solution comprises nickel and chromium, the first component comprises a binary compound, a ternary compound, or both comprising at least one transition metal element and at least one nonmetal element; and the alloy is represented by the formula:

$$(Ni_xCr_y)_a(M_bN_c)$$

wherein:

M represents the transition metal element in the first component;

N represents the nonmetal element in the first component;

a, b, and c each is greater than 0 and independently represents a weight percentage;

x and y each is greater than 0 and independently represents a weight percentage of the Ni-containing solid solution;

a is from 85 to 95, b is from 0.1 to 10, c is from 5 to 10, a ratio of x to y is between 0.5 to 1.9, and y is 33-35;

wherein the alloy comprises:

48 to 54 wt. % Ni,
33 to 35 wt. % Cr,
3.3 to 3.5 wt. % Si,
4 to 4.5 wt. % B,
about 1 wt. % C,
1-2 wt. % Ti,
and a balance of Fe; and wherein the coating is substantially amorphous.

2. The coating of claim 1, wherein the nonmetal element further includes at least one of F, Cl, Br, I, At, O, S, Se, Te, Po, N, P, As, Sb, Bi, Ge, Sn, or Pb.

3. The coating of claim 1, wherein the transition metal element further includes at least one of Sc, Y, La, Ac, Zr, Hf, V, Nb, Ta, Cr, Mo, W, Mn, Tc, Re, Ru, Os, Co, Rh, Ir, Ni, Pd, Pt, Cu, Ag, Au, Zn, Cd, or Hg, or combinations thereof.

4. The coating of claim 1, wherein the first component comprises at least one of (i) a boride or (ii) a carbide.

5. The coating of claim 1, further comprising a second component comprising at least one transition metal element and at least one nonmetal element.

6. The coating of claim 1 wherein the coating is fully amorphous.

* * * * *